United States Patent [19]

Carr

[11] Patent Number: 4,457,838

[45] Date of Patent: Jul. 3, 1984

[54] SELF-CLEANING MAGNETIC SEPARATOR FOR POWDERED PLASTIC AND METAL MATERIALS AND METHOD

[76] Inventor: Ronald Carr, 23743 Research Dr., Farmington, Mich. 48024

[21] Appl. No.: 382,137

[22] Filed: May 26, 1982

[51] Int. Cl.[3] ..... B03C 1/26

[52] U.S. Cl. ..... 209/223.2; 209/229

[58] Field of Search ..... 209/215, 214, 217, 223 A, 209/223 R, 228, 229; 210/222, 223; 55/100

[56] References Cited

U.S. PATENT DOCUMENTS 2,912,106 11/1959 Martin ..... 209/223.1

3,712,472 1/1973 Elliott ..... 209/222

FOREIGN PATENT DOCUMENTS 14289 8/1980 European Pat. Off. ..... 209/214

*Primary Examiner*—Richard L. Chiesa

*Assistant Examiner*—William J. Bond

*Attorney, Agent, or Firm*—Cullen, Sloman, Cantor, Grauer, Scott & Rutherford

[57] ABSTRACT

A magnetic separator for mixtures of powdered plastic and metal comprises a housing having an inlet, a base plate and side plates. A plurality of vertically spaced staggered rows of laterally spaced pilot tubes span, extend through and are secured to the side plates to define a circuitous material falling path. An upright tube clearance plate is arranged intermediate the side plates and has a corresponding plurality of vertically spaced rows of laterally spaced apertures, oversized with respect to and loosely receiving the tubes defining clearance apertures. The clearance plate defines on one side an upright plastic feed chamber having an outlet in the base plate. An upright wiper plate is arranged between the clearance plate and one side plate having a corresponding series of apertures snugly receiving the tubes and defining with the adjacent side plate an upright metal feed chamber having an outlet. The elongated magnetic assembly is slidably mounted upon and intermittently reciprocal within each tube and is normally positioned within the plastic feed chamber. Falling particles of plastic cascade over the tubes within the plastic feed chamber for delivery through its outlet. Falling metal particles adhere to the tubes and upon intermittent retraction of the magnetic assemblies accumulated metal slides along the tubes through the clearance plate and into the metal feed chamber with the wiper plates stripping the metal, particles from the tubes to fall within the metal feed chamber and through its outlet.

23 Claims, 7 Drawing Figures

FIG. 1
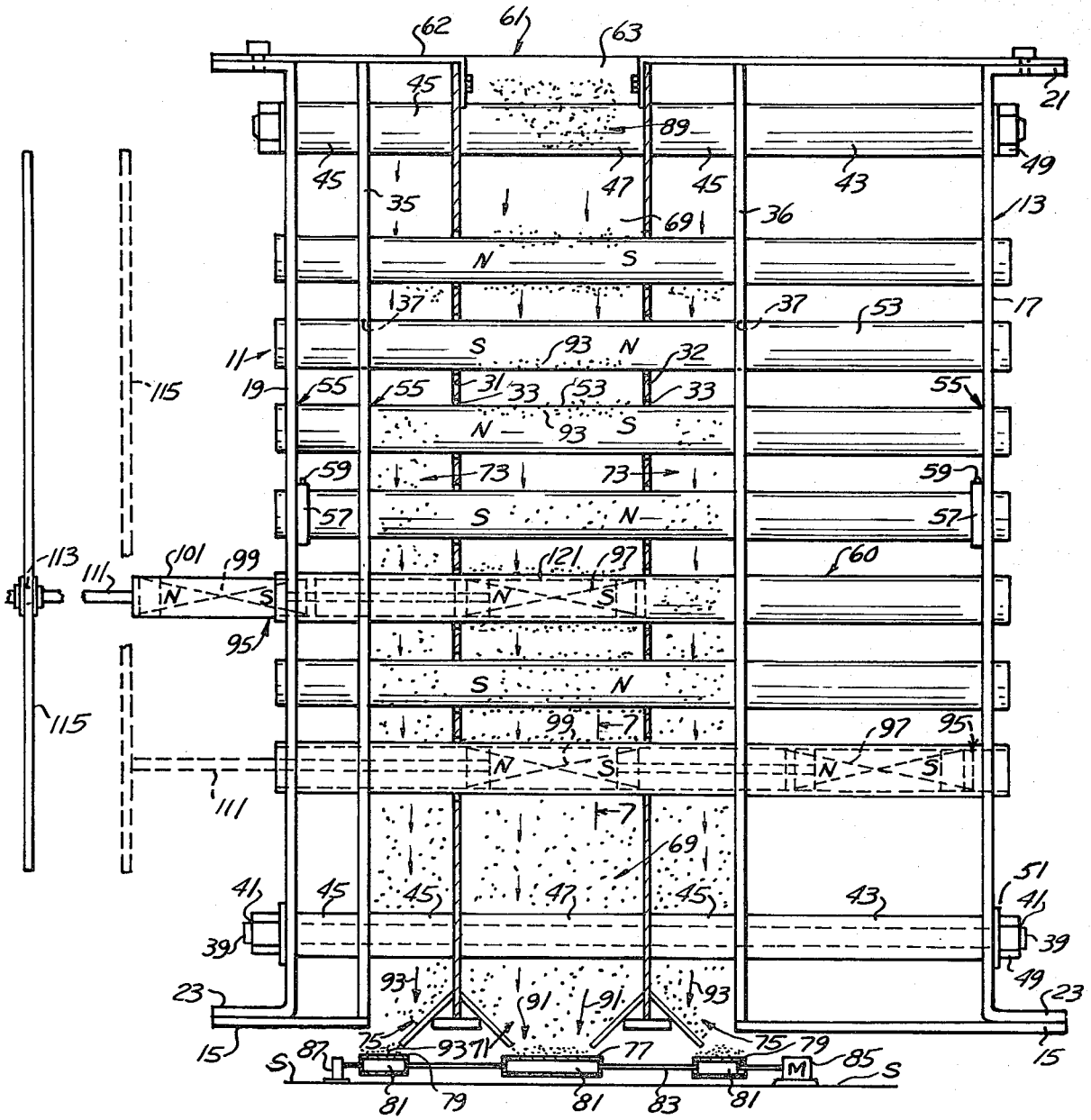
FIG. 3
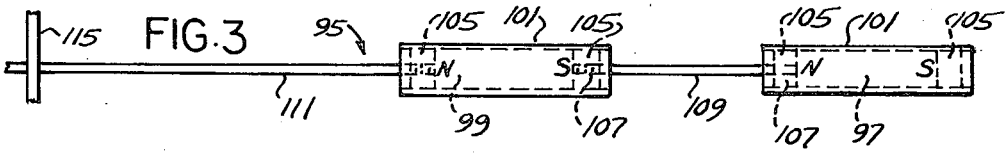
FIG. 4
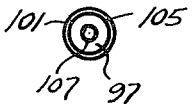
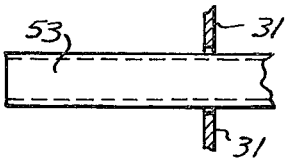
FIG. 5

AIR

SELF-CLEANING MAGNETIC SEPARATOR FOR POWDERED PLASTIC AND METAL MATERIALS AND METHOD

BACKGROUND OF THE INVENTION

Heretofore in the auto and other industries, plastic parts have been chrome plated wherein considerable quantity of plastic parts are rejected for improper finish or improper plating or from other defects in the final product such as would render plastic material, usually acrylonitrile-butadiene-styrene polymer, hereafter referred to as A.B.S., though not limited thereto, for scrap and waste. Plastic chrome plated rejects are in abundance in very large quantities at 14 cents per pound for regrinding whereas prime plastic material has a value of one dollar per pound, approximately. Heretofore in forming plastic articles, there are impurities within the plastic material. Such impurities may show up in the final injection molded plastic product or other plastic product as irregular surfaces. Ferrous, copper and chrome dust powder often damages the sprue and mold in an injection molding machine, often destroying the high gloss finish required on chrome parts of new products. These chrome plated products are often rejected with great loss of profits, plus injury to equipment, wherein the rejected plastic product must be reground for use to recover some of the loss. Various efforts have been made for removing principally the chrome from the reground plastic product, or other metal materals such as copper, nickel and certain ferrous powders.

Various efforts have been made to try to purify the scrap chrome plated plastic, however it appears that these efforts have been unsuccessful, since no effective means has been developed for separating substantially all of the chrome and other metals from the ground up reject plastic parts.

Heretofore electromagnetic systems have been tried, however, essentially these have been ineffective due to the reluctance of some of these materials such as chrome, nickel, copper to adhere to magnets. Efforts have been made to provide a manual type of magnetic separator wherein before ground plastic pellets are fed into a molding machine, or into extruders, the material is passed over a series of tubes containing magnets. After some of the metal material has adhered to the tubes, the tubes must be moved from the machine and manually wiped off before they can be used again often resulting in a shut-down of the plastic equipment resulting in an inefficient separation of only some of the metal materials.

Since the plastic material before melting and injection into a plastic mold is of a relatively fine powder of approximately 30 mesh, for illustration, initial efforts to magnetically separate such metal materials from the plastic such as chrome, copper, nickel and iron, have been ineffective due to the continuous flow of the greater quantity of plastic materials through the separator as the material passes into a conventional extruder, or other device for liquifying the plastic material prior to molding.

SUMMARY OF THE INVENTION

An important feature of the present invention is to provide an improved self-cleaning magnetic separator which is particularly adapted for a mixture of powdered plastic and metal materials and particularly materials which contain chrome, copper, nickel and iron particles.

An important feature of the present invention is to provide an improved magnetic separator which is capable of removing more than 99% of all metal particles from the plastic material and the separation thereof so that the plastic material used is relatively pure, eliminating subsequent rejects of molded parts which have been chrome plated and preventing damage to the mold equipment sprue and walls of the mold cavities heretofore accompanied by the use of plastic material contaminated with too much metal particles therein.

A further feature contemplates the use of magnetism produced by hard magnets and utilizing the effects of static electricity, the application of positive and negative charges to the metallic particles as they are successively ground for introduction into the magnetic separator and utilizing these charges as applied to the metal materials and mixed with the plastic to assist in the magnetic separation of the metal materials from the continuously flowing plastic materals.

A further feature is to provide within a housing having side plates, a clearance plate intermediate the side walls of the housing through which a plurality of staggered vertically spaced rows of laterally spaced tubes extend and wherein the corresponding apertures in the clearance plate are oversized with respect to the tubes to provide a plurality of clearance apertures surrounding said tubes.

A further feature incorporates into the present apparatus and method the use of a similarly apertured stripper plate which is interposed between the clearance plate and one of the side walls which snugly receives the series of tubes and which defines within the housing a metal flow chamber.

A further feature includes the use of a plurality of magnetic assemblies which are normally nested within the tubes within the housing and arranged adjacent and within the plastic flow chamber defined between the clearance plate and one side plate of the housing.

During a continuous flow of the pulvarized or powdered mixture of metal materials and plastic over a circuitous path defined by the tubes within the plastic flow chamber from an inlet in the top of the housing, progressively metal particles will be magnetically attracted to portions of the tubes within the plastic flow chamber and will build up and accumulate upon the tubes along the surface thereof and particularly upon the underside thereof during the cascading of the plastic particles over the tubes. On an intermittent basis, the magnetic assemblies are simultaneously retracted by a push plate, power operated, by which all of the magnetic assemblies are retracted within the tubes from a position adjacent the plastic flow chamber into and through the metal material flow chamber and outwardly thereof wherein the metal particles accumulated and built up upon the respective tubes are magnetically slid and translated along the tubes through the clearance apertures in the clearance plate and into the metal flow chamber and upon continued retracting movement of the magnets outwardly of the metal flow chamber. The wiper plate magnetically separates the metal materials from the tube stripping the particles therefrom, the metal particles being free to fall by gravity over the adjacent underlying staggered tubes within the metal flow chamber for separate outletting through the bottom wall of the housing.

Once the stripping function has been achieved, a power means is energized for returning all of the magnetic assemblies simultaneously back to their initial position within the respective tubes adjacent to and within the plastic flow chamber for a continuation of the automatic magnetic separation process.

A further feature of the present invention includes for each magnetic assembly a pair of longitudinally spaced magnets having dissimilar poles at their opposite ends, wherein as one of the magnets are retracted from the plastic flow chamber into the metal flow chamber and outwardly thereof, the second magnets are successively positioned within the tubes within the plastic flow chamber so that magnetic separation continues without interruption. The magnetic devices are positioned within the metal flow chamber substantially at all times.

A further feature provides in the present magnetic separator and method a means by which the plastic particles have been cleaned and have separated therefrom substantially all of the metal materials, so that the reclaimed plastic material is considered relatively pure.

A further feature contemplates that there may be a salvage of the metal particles separated from the plastic particles and this material also has a high salvage value.

The present magnetic separator has for its primary purpose the removing of fine powdered specs of chrome, copper, nickle and fine dust ferrous materials from A.B.S. plastic regrounds of chrome plated plastic products for restoring the plastic to its original pure state so that the material may be molded and chrome plated again saving cost of up to and exceeding 70 cents per pound, avoiding damage to the sprue and the highly finished surfaces of mold cavities. By providing reclaimed plastic which is relatively pure of metal materials factory costs are reduced, since the part doesn't have to be recast or remolded due to pitted chrome or damage to the otherwise glossy surface saving delays and improving quality control. The use of the present self-cleaning apparatus and the function and operation thereof is automatic and continuous, requiring no shutdown of associated equipment.

These and other objects and features will be seen from the following Specification and claims in conjunction with the appended drawings.

THE DRAWINGS

FIG. 1 is a fragmentary side elevational view of the present self-cleaning magnetic separator with one magnetic assembly shown in a retracted position.

FIG. 3 is a side view of one magnetic assembly.

FIG. 4 is an end view thereof.

FIG. 5 is a fragmentary view of a tube and clearance plate shown in FIG. 1.

Figures 2, 6, 7:
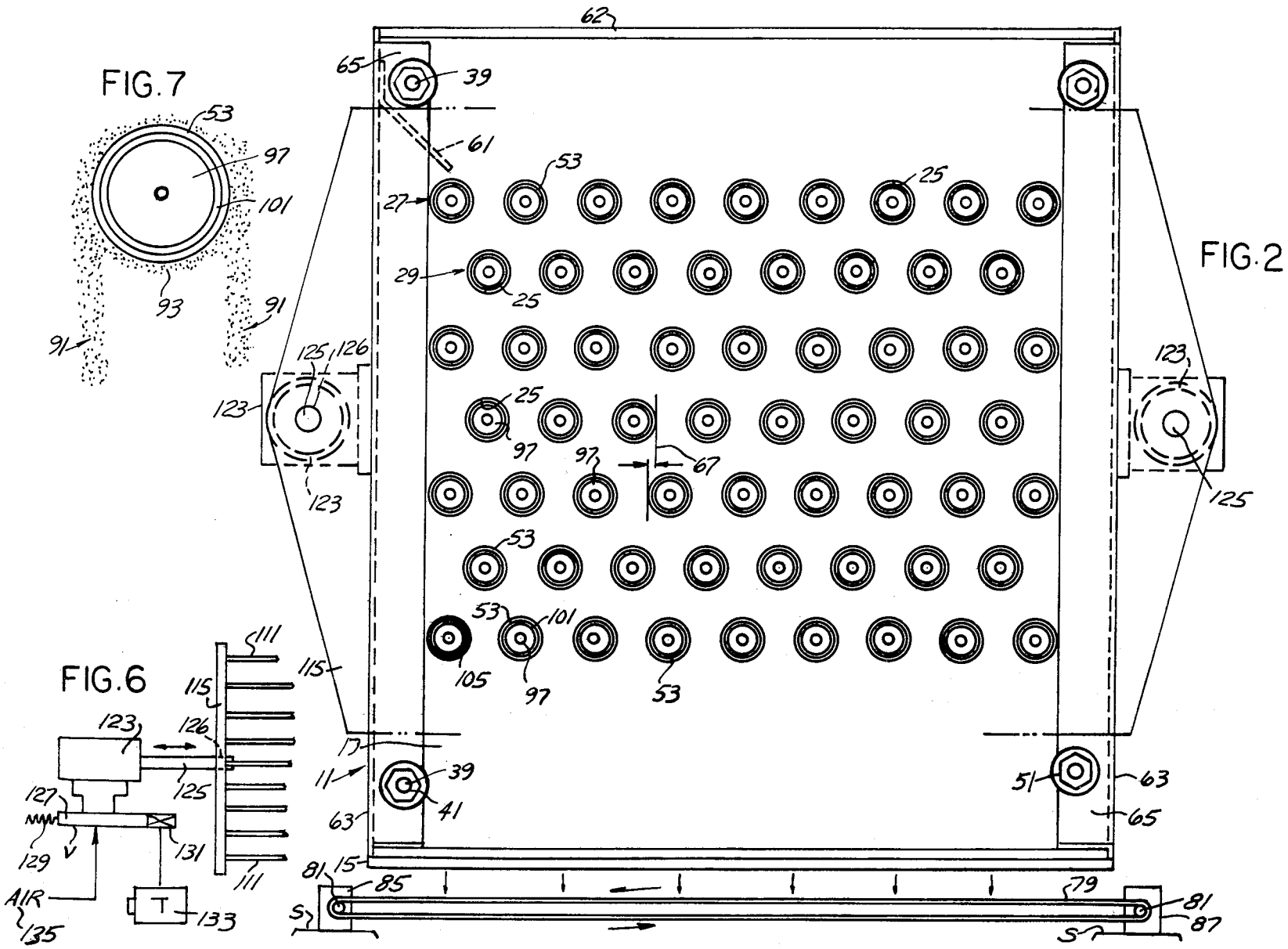
FIG. 2 is a front elevational view thereof.
FIG. 6 is a fragmentary schematic view of the reciprocal power mechanism for operating the pull plate connected to the magnetic assemblies.
FIG. 7 is a fragmentary section taken in the direction of arrows 7—7, of FIG. 1.

It will be understood that the above drawings illustrate merely a preferred embodiment of the invention, and that other embodiments and method steps are contemplated within the scope of the claims hereafter set forth.

DETAILED DESCRIPTION OF AN EMBODIMENT OF THE INVENTION

Referring to the drawings, the present self-cleaning magnetic separator generally indicated at 11 in FIG. 1, includes an upright housing 13 having an apertured base plate 15, a pair of opposed spaced upright side plates 17 and 19 with outwardly directed top flanges 21 and bottom flanges 23 supported upon and secured to base plate 15.

Formed within the side plates 17 and 19, and as shown in FIG. 2, there are a plurality of vertically spaced rows 27, 29 of laterally spaced tube apertures 25. Each of the adjacent rows 27 and 29 of tube apertures are laterally staggered from top to bottom of the housing.

A corresponding series of vertically spaced rows of laterally spaced pilot tubes 53 span the side plates 17 and 19, project therethrough and are secured thereto as by a press fit.

Arranged within the housing and intermediate the side plates 17 and 19 are a pair of spaced upright clearance plates 31–32 having formed therein corresponding series of vertically spaced rows of laterally spaced tube clearance apertures 33, which loosely receive the corresponding pilot tubes 53 which extend between the side plates 17 and 19. The apertures 33 in clearance plates 31–32 are oversized with respect to the outside diameter of the corresponding tubes 53.

The respective vertically spaced rows 27, 29 of laterally spaced staggered tubes 53 define with clearance plates 31 and 32 and end plates 63 a circuitous falling path 69 within the housing for a mixture of powdered plastic and metal materials directed into the housing through the inlet 61 in top plate 62.

Upright wiper plates 35–36 are positioned within said housing intermediate the clearance plates 31–32 and the adjacent side plate 19, 17 and have a corresponding series of vertically spaced rows of laterally spaced apertures 37 snugly receiving corresponding pilot tubes 53, FIG. 1.

The housing is retained as a unit by a plurality of vertically spaced transverse anchor rods 39 which are threaded at their ends 41, extend through a series of aligned spacer tubes 43, 45 and 47 with respect to the side plates 17 and 19, clearance plates 31–32 and wiper plates 35–36 and are secured together by a plurality of fastening nuts 49 with interposed washers 51.

In the preferred embodiment of the invention, the housing is essentially constructed of aluminum including the side plates 17 and 19, base plate 15 and end plates 63, clearance plates 31–32, wiper plates 35–36, as well as the spacers 43, 45 and 47.

The respective pilot tubes 53, preferably constructed of a nonmagnetic stainless steel such as 302–4 SS, are secured with respect to the side plates 17 and 19 as by press fit shown at 55, FIG. 1. Additionally, collars 57 are mounted upon end portions of the respective pilot tubes 53 inwardly of the side plates 17 and 19 and are secured thereto as by the transverse pins or set screws 59.

The housing includes a pair of spaced end plates 63, which as shown in FIG. 2, include side flanges 65 which overlie and bear against side portions of the side plates 17 and 19.

In view of the staggered relationship of the rows 27 and 29 of the apertures 25 within the side plates 17 and 19, there is a lateral overlap 67, FIG. 2, between adjacent tubes of the underlying rows 27 and 29 throughout the height of the housing whereby falling materials have a circuitous flow path within the plastic flow chamber 69 and will successively cascade over and impinge upon the underlying sets of tubes within the plastic flow chamber.

Said chamber has a converging outlet 71 through which is delivered at the base of the housing, plastic particles such as A.B.S., or any other plastic from which the metal materials have been magnetically separated.

Clearance plates 31 and 32 with oversized clearance apertures 33, define with wiper plates 35, 36 a pair of upright metal feed chambers 73 for the delivery of magnetically separated metal particles specifically chrome, copper, nickel and ferrous particles, which drop by gravity over the same circuitous path defined by the pilot tubes within the upright metal feed chambers 73 and are delivered through the corresponding converging outlets 75 passing through the base 15.

Schematically shown in FIG. 1, is laterally spaced conveyor 77 which underlies the plastic particle discharge outlet 71 for receiving plastic particles, such as the A.B.S. particles 91. The outer conveyors 79 underlie the housing 11 and are apaced below discharge outlets 75 of the metal feed chambers 73 and adapted to receive metal particles 93 which include chrome essentially and with some particles of copper, nickel and iron which accumulate upon conveyors 79.

Each of the respective conveyors have at their one ends as in the case of continuous conveyors, the laterally spaced drive spools 81 upon the shaft 83 which at one end is connected to the output of the motor 85 upon the surface S. The opposite end of the shaft is mounted upon a journal block 87 upon surface S, to provide one form of drive means for the underlying conveyors 77 and 79 for transporting away separately and independently the plastic materials 91 on conveyor 77 and the powdered metal materials 93 upon conveyors 79.

The opposite ends of the corresponding conveyors 77, 79 are journaled around corresponding rollers 81, as in FIG. 2, whose shaft is supported by corresponding journal blocks 87.

The elongated magnet assembly, generally indicated at 95 is slidably nested within each of the pilot tubes 53. The magnet assembly includes the first magnet 97 and longitudinally spaced therefrom the aligned second magnet 89. Each of the magnets are housed within an elongated stainless steel tube 101, closed at its opposite ends by the press fitted stainless steel plugs 105. Some of the plugs 105 are threaded at 107 and are adapted to receive the threaded ends of the spacer rod 109, FIG. 1. The elongated push rod 111 is aligned with the magnets 97 and 99 and at one threaded end is secured to the threaded plug 105 at the forward end of the second magnet 99.

A magnet assembly 95 is normally nested within each of the respective pilot tubes 53, and in FIG. 1, the illustrative upper magnet assembly is shown in a retracted position. The forward threaded ends of the respective magnet push rods 111 extend through corresponding apertures 113 in the upright push plate 115 and are secured thereto. The corresponding magnetic assemblies including the tubes 101 are slidably positioned with a slip fit clearance 121 within the pilot tubes 53.

When the push plate 115 has been moved to the dash line position shown relative to side plate 19, the left hand second magnet 99 has been moved to the position shown occupied by the first magnet 97. At the same time the first magnet 97 has moved outwardly to the right of wiper plate 36 to an inactive position within tube 53.

As shown in FIGS. 2 and 6, there are provided a pair of laterally spaced double action cushion cylinder assemblies 123, respective piston rods 125 extending to the push plate 115 and are secured thereto as at 126. In the illustrative embodiment, cushion cylinder 123 is a double action air cylinder whose opposite ends are connected to the electro controlled valve 127, schematically shown, connected to a source of pressurized air 135.

The valve element therein is normally biased to one position by the coil spring 129 and is caused to move in the opposite direction by the solenoid 131, schematically shown. In the illustrative embodiment the solenoid is connected to a split second cycle repeat timer 133 which may be set between 1 and 10 minutes for the cycle of operation thereof.

In normal operation, the solenoid 131 is electrically energized and the valve is controlled so that the piston rod 125 is fed inwardly so that the push plate assumes the dash line position shown in FIG. 1 adjacent side plate 19. In such position, and with all of the magnetic assemblies connected by their corresponding rods 111 to said push plate, each of the respective second magnets 99, lower illustration, are positioned within plastic flow chamber 69.

Accordingly in FIG. 1, each of the respective magnetic assemblies 95 are shown in the retracted position (upper illustration) under the control of the double action cylinders 123. The solenoid 131 is deactivated and the spring operated valve is biased to such position that the pneumatic connections from the pressurized air source 135 effects a retraction of the piston rod 125 and pusher plate 115 to the position shown in FIG. 1.

OPERATION

In operation, there is introduced into the inlet 61 an admixture of finally divided pulvarized or powdered plastic material such as A.B.S. and within which are a plurality of metal particles such as chrome, copper, nickel and some ferrous particles.

The mixture 89 is finally divided as a powder such as would pass through a 30 mesh screen. The mixture is introduced into the housing through the inlet 61, adapted for downward movement by gravity over the circuitous path within the plastic flow chamber 69 as defined by the staggered rows of vertically spaced pilot tubes 53.

As shown in FIG. 1, the respective magnets 95 and 97 are of opposite polarity at their opposite ends for defining an impressed magnetic flux to the opposite ends of the corresponding pilot tubes 53. The polarity of the respective magnets 97 in the vertically spaced tubes is reversed between vertically spaced rows and between laterally spaced tubes.

The falling particles plastic material 91 cascade down and over the circuitous path between the respective pilot tubes 53 within the plastic flow chamber 69 and are adapted for delivery out through the converging discharge outlet 71 onto the underlying conveyor 77 for transport outwardly of the housing.

Since the powdered mixture 89 as introduced through the inlet at the top of the housing at 61 has passed through a series of crushers and grinders to be presented in powdered form, a certain amount of static electricity or other charge is impressed upon the particles so that the metallic particles within the admixture have at the beginning of the separation a positive or negative charge imposed thereon. The impressed charges may be caused other than by static electricity. Accordingly in cascading over the corresponding staggered rows of spaced tubes 53, the metal particles of the mixture will selectively and progressively adhere to and along the length of the pilot tubes 53 as designated at 93 in FIG. 7. Some of the metallic particles will adhere to the tubes upon the upper quadrant thereof, above a horizontal plane through the tube 53. The remainder and majority of the metallic particles will magnetically adhere to undersurface portions of the tubes 53 laterally inward of the downwardly moving path of cascading plastic materials.

The downward movement of the plastic materials continuously moving over the respective pilot tubes, tends to wash the metallic particles 93 downwardly so that a minimum thereof will adhere to the upper portions of the pilot tubes 53. However, due to the magnetic attraction between the oppositely charged metal particles and the oppositely charged or impressed charged portions of the pilot tubes 53, the material will slide along the surface of the round tubes 53 and will collect laterally inward under the tubes out of the path of downward movement of the flowing plastic 91, as schematically shown in FIG. 7.

At a time interval which is preset by the setting of the repeat cycle timer 133, FIG. 3, after a sufficient period for a substantial accumulation of metal particles 93 upon the respective pilot tubes 53, the timer will deactivate the solenoid 131 and the air connections to the pneumatic cylinder 123 will be reversed and the pusher plate 115 retracted to the position shown in FIG. 1.

Second magnet 99 of the magnetic assembly has moved to the position (upper illustration) shown in FIG. 1. The first magnetic assembly 97 has been retracted to the position also shown in FIG. 1 so as to remain in the plastic flow chamber 69 and in the path of continuous flowing particles.

In view of the opposite polarity of the corresponding magnets within each of the magnetic assemblies 95 and 99 and due to the opposite polarity impressed magnetically or otherwise charged into the falling metal particles 93, the metal material as it has accumulated upon the pilot tubes 53 within the plastic flow chamber 69 will be slid by the magnetic attraction of the retracting magnets 99 so that the accumulated metal material will pass through the clearance apertures 33 in the clearance plate 31. As the magnet 99 continues to move laterally outward through the wiper plate 35, the metal materials will be slid and transferred into the metal material flow chamber 73 upon the respective tubes 53 and ultimately stripped from said tubes as the magnet 99 retracts downwardly of the metal flow chamber through the wiper plate 35 such as to the upper illustration shown in FIG. 1.

The metallic particles of essentially chromium and the other metals referred to above are adapted to fall by gravity through the metal material flow chamber 73 through the converging outlet 75 adjacent the base plate 15 and onto the underlying horizontally disposed conveyor 79 for transport away from the housing.

Accordingly the stationary wiper plate 35 and alternately wiper plate 36 function to mechanically strip the accumulated metal particles 93 upon the pilot tubes 53 which have been positioned magnetically within the metal material flow chamber 73 to provide for the automatic separation of the metal powder ingredients such as the chromium nickle, copper and iron from the pulverized plastic material which continuously falls through the plastic flow chamber 69.

In view of the multiplicity of different atoms which compose the plastic, chrome, copper and ferrous material, as received from the grinder there is a reluctance of some of this metal material to be attracted to the conventional hard magnet or otherwise have poor magnetic qualities as compared from such magnetic materials such as iron which is readily attracted to such magnets.

Since the mixture of plastic and metal particles, including chrome, nickel, iron and copper has been previously ground and handled in one or a series of steps before transmission through the present magnetic separator, it is believed that magnetic charges have been impressed upon the metal particles of one polarity or the other or of opposing polarities such as to render the magnetic material more attractive than otherwise in the use of the present permanent magnets or magnetic assemblies within the pilot tubes.

Keeping in mind that the material is in the form of a relatively fine powder such as would pass through a 30 mesh screen, for example, the specs of metal are quite small. It appears that a charge has been impressed upon the metal materials, whether it be a magnetic charge or a static electrical charge, such as to render these metal materials attractive to the magnetic assemblies within the respective pilot tubes.

The weight of the plastic material falling through the plastic flow chamber, has a tendency to wash the metal materials downwardly. By the use of the transversely round magnet assemblies and particularly the pilot tubes of cylindrical construction, the force of the weight of the flowing plastic material causes the specs 93 to adhere to and move around the surface portions of the pilot tubes so as to underlie a central plane passing horizontally through the tubes. The material essentially accumulates to the greatest extent upon the under half portion of the tubes as shown in FIG. 4. There, the material 93 as accumulated is protected from the weight of the downfall of plastic material 91 which is flowing continuously.

Under the present apparatus and the method employed, there are sufficient free electrons available with the help of static electricity or otherwise impressed magnetism depending upon the polarity of the charge applied to the magnetic particles before delivery into the housing, and further depending upon the opposite polarity of the respective magnetic assemblies within the pilot tubes, that the metal materials 93 and particularly the chrome will separate out from the flowing plastic material and will adhere to and along the length of the respective pilot tubes within the plastic flow chamber 69. Accordingly, after such sufficient accumulation of the metal particles, the magnetic assembly is automatically retracted under a time cycle arrangement and wherein the underlying magnets 99 are retracted such as to the position shown in FIG. 1. The material accumulated upon the pilot tubes 53 under magnetic attractive forces transversely slide through the clearance apertures 33 in the clearance plate 31 and into the metal collection chamber or metal passage chamber 73. On continued retraction of the magnets to the position shown to the left at 99, FIG. 1, the material adhered upon the pilot tubes 53 within the chamber 73 is stripped therefrom as the magnetic force moves transversely away from said chamber through the wiper plate 35. The metal particles 93 are stripped from the tubes 53 and fall by gravity through the passage 73 and through the converging outlet 75. The particles 93 accumulate upon the underlying horizontally disposed conveyor 79.

By the present arrangement, it appears that as the flowing metal particles initially impinge upon the corresponding pilot tubes 53 within the plastic delivery chamber 69, some of the metal particles may pass some of the pilot tubes and will adhere to other tubes thereunder in the progressive fashion so that by the time the material has fallen past and through the circuitous passage defined by the overlap of the tubes as shown at 67, FIG. 1, substantially all of the metal materials have magnetically adhered to some of the pilot tubes 53. Accordingly, this material then is transferred by a magnetic attractive sliding step so that the material slides through the clearance apertures 33 in the clearance plate 31 and moves into the metal feed chamber 73.

Thus, there is delivered relatively pure plastic material 91 through the outlet 71 which can be re-used, which is in prime condition and has the greatest value for re-use to avoid any metal contamination.

During the initial retraction of the second magnetic assembly 99 to a position (upper illustration) shown in FIG. 1, the first magnetic assembly 97 is in a position so as to be in the path of downward movement of the mixture of metal and plastic material within the plastic flow chamber 69. Thus, at all times, there are magnetic assemblies available within the corresponding pilot tubes in the plastic flow chamber 69 such as to intercept and to withdraw metal particles from the continuously cascading plastic particles.

Therefore, when the cycle timer reverses and the magnets return the second magnet 99 will occupy the position (lower illustration) of the first magnet 97, FIG. 1, and the first magnet will have moved outwardly to the right through stripper plate 36 adjacent housing side wall 17. Accordingly, as the first magnet 97 is moved outwardly to the right from the retracted upper illustration 1, any accumulated magnetic materials upon the pilot tubes 53 will be magnetically stripped therefrom at plate 36 and will falling through the second metal flow chamber 73 and onto the adjacent conveyor 79. Thus, the pilot tubes are wiped clean in advance of the return of the magnets 97 from the advance position shown in FIG. 1 (lower illustration) to the retracted position.

The timing of the cycle timer may be regulated between 0 and 10 minutes depending upon the extent of metal material pollution within the plastic material.

The present invention includes the method of separating a mixture of powdered plastic and metal materials which comprises the steps of:

introducing the mixture into the top of a plastic feed chamber containing a plurality of vertically spaced staggered rows of laterally spaced pilot tubes, each containing a magnetic assembly;

cascading the mixture by gravity through a circuitous path over the tubes;

magnetically adhering the metal particles of said mixture to surface portions of the tubes during the downward flow of plastic material;

retracting simultaneously the metal magnetic assemblies in all of the tubes and magnetically sliding the accumulated metal particles adhering to the tubes out of the plastic feed chamber and into a metal feed chamber;

and successively magnetically stripping the metal particles from the pilot tubes on retraction of the magnetic assemblies through and outwardly of the metal feed chamber, the separated metal particles falling by gravity through the metal feed chamber.

A further step includes the independent collecting of the separated plastic and metal materials falling from the plastic and metal feed chambers by the use of a pair of laterally spaced conveyor assemblies which underlie the housing.

The Inventor claims that the present magnetic separator may be of a large capacity, self-cleaning with no down time or shut-off time. A magnetic assembly is in the path of powdered material at all times. The separator is capable of doing large amounts of magnetic separation per shift for the volume molding of plastic products.

The present method and apparatus avoids serious costly damage to the sprue and high gloss finish molds used for forming plastic products due to the removal from the plastic material of chrome, copper, nickel and iron.

To the inventor's knowledge, no other equipment on the market today takes out the unwanted copper and chrome powders from regrinding of plastic chrome plated parts.

The present equipment allows the user who can purchase scrap, chrome plated parts to regrind at 14 cents per pound and then sell the material back at one dollar per pound, i.e., a tremendous savings to many of the large molders who use 3,000 pounds of good plastic per hour.

The present equipment requires only air and no large space or electric motors, except possibly for the conveyors assemblies.

The present invention is helpful to the economy because with the high cost of oil and the high cost of plastic, which is made from oil, the present separator provides for the re-use of chrome plated plastic parts. The invention helps the environment eliminating plastic liter, since the plastic once purified may be re-used for additional mold purposes.

The present machine and method recovers copper and nickel for resale to foundaries. The machine once set in operation requires no employees to watch, clean or stop while cleaning, since the cycle repeat timer attached to the pneumatic cylinder assembly is functioning automatically at all times and can be preset to the required cycle for intermittent feed movements of the magnetic assemblies.

The present method provides a means for improving quality control and delivery dates of finished plastic products. The apparatus should save many thousands of dollars as the finished product does not have to be made twice and since the plastic purified material provided is free of metal contamination.

The machine is good insurance on prime plastic material that has never been chrome plated before, as there is always some metal from the extruders that grind the material in the original powder and this metal can be separated from the plastic by the method and apparatus above described.

The apparatus saves on liability insurance as the product may be made and you don't have to know the condition of the finish until after the part is chrome plated. This saves on recalls in chrome plating used such as for radiator grills, water faucets and other chrome plated plstic products.

This should help the country fight inflation and maintain plastic manufacturing firms in a completitive position.

The apparatus is made of stainless steel and aluminum to meet stringent food and chemical requirements. The machine and apparatus can be used for research in colleges, medical usages, separation of metals from foods and spices and for separation of metal impurities from other precious metals of a non-magnetic character.

Having described my invention, reference should now be had to the following claims:

I claim:

1. A self cleaning magnetic separator for a mixture of powdered plastic and metal materials comprising of a housing having an inlet to receive said materials, an apertured base plate, side plates and end plates;

said side plates having a plurality of opposed vertically spaced rows of longitudinally spaced circular tube apertures therein;

a plurality of correspnding vertically spaced rows of laterally spaced pilot tubes snugly extending through said apertures, spanning said side plates and secured thereto;

the tubes in one row being laterally displaced with respect to the tubes of an adjacent row of tubes to define a circuitous falling path within said housing for said materials;

an upright tube clearance plate within said housing intermediate said side plates having a corresponding series of apertures oversized with respect to said tubes defining a corresponding series of clearance apertures surrounding said tubes;

said clearance plate defining on one side thereof an upright plastic feed chamber communicating with said inlet and having a throated outlet extending through said base plate;

an upright wiper plate within said housing intermediate said clearance plate and one side plate having a corresponding series of apertures snugly receiving said tubes respectively, defining with said clearance plate an upright metal feed chamber for metal materials separated from said plastic materials and having a throated outlet extending through said base plate;

an elongated magnet assembly slidably mounted upon and intermittently reciprocal within each tube;

each magnetic assembly being of a length substantially corresponding to the length of said tubes within said plastic feed chamber;

and normally positioned within said plastic feed chamber;

and a pusher plate upon the exterior of said housing connected to said magnetic assemblies for effecting intermittent reciprocal movement thereof;

falling particles of plastic material cascading down and over said tubes within said plastic feed chamber for delivery through its outlet;

falling particles of metal within said plastic feed chamber adhering to said tubes;

retraction of said pusher plate and connected magnetic assemblies through and outwardly of said metal feed chamber sliding the accumulated metal material along the respective pilot tubes through said clearance plate and into and through said metal feed chamber;

said wiper plate stripping said metal materials from said tubes, said metal material falling by gravity within said metal feed chamber and through its outlet.

2. In the magnetic separator of claim 1, said mixture of powdered material including plastic, chrome, copper and nickel.

3. In the magnetic separator of claim 2, said plastic being A.B.S.

4. In the magnetic separator of claim 1, said powder being of the size approximately to pass through a 20–30 mesh screen.

5. In the magnetic separator of claim 1, said housing being made of aluminum, said pilot tubes of non-magnetic stainless steel.

6. In the magnetic separator of claim 1, a plurality of anchor rods threaded upon their ends extending transversely through said side plates, clearance and wiper plates;

tubular spacers upon said rods extending between adjacent plates;

and fasteners upon the rod ends in tight retaining engagement with said side plates.

7. In the magnetic separator of claim 1, said magnetic assembly including a cylindrical magnet of opposing polarity of adjacent its opposite ends for delivering fluxes of corresponding polarity to adjacent portions of the surrounding pilot tube, whereby the metal particles depending upon any impressed magnetism therein, including static electricity, will selectively adhere to said pilot tubes along their length within the plastic feed chamber as said mixture cascades progressively over said tubes.

8. In the magnetic separator of claim 7, the polarity of adjacent vertically spaced magnets being reversed end to end to magnetically entrap the falling metal particles as they progressively fall past said tubes.

9. In the magnetic separator of claim 1, said magnetic assembly including a cylindrical magnet of opposing polarity adjacent its opposite needs for delivering fluxes of corresponding polarity to adjacent portions of the surrounding pilot tube;

and a pusher rod at one end axially connected to said magnet and a its other end projecting from said pilot tube and connected to said pusher plate.

10. In the magnetic separator of claim 9, each magnet assembly including a tubular body of non-magnetic stainless steel receiving said magnet, plugs secured upon the ends of said body enclosing said magnet, said push rod being connected to an end plug.

11. In the magnet separator of claim 1, a double acting cylinder assembly having a reciprocal piston rod connected to said pusher plate for intermittently retracting and successively advancing said pusher plate, whereby each magnet assembly, normally located within its pilot tube within the plastic feed chamber during the passage of the mixture of material therethrough, after a predetermined period during build-up of metallic material upon said pilot tube within said plastic feed chamber, is retracted.

12. In the magnetic separator of claim 11, a control valve connected to a source of pressurized air and to opposite ends of said cylinder assembly, normally maintaining its piston rod advanced; and an adjustable repeat cycle timer connected to said valve for presetting the cycle of intermittent retraction and return of each magnetic assembly.

13. In the magnetic separator of claim 1, and a pair of laterally spaced double acting cylinders, each having a piston rod connected to said pusher plate intermediate its top and bottom, for intermittently retracting and successively advancing said pusher plate and connected magnetic assemblies in a timed repeated cycle at predetermined intervals.

14. In the magnetic separator of claim 1, each magnetic assembly including a pair of aligned longitudinally spaced tubular bodies normally positioned between said side plates and upon one side of said clearance plate and wiper plate;

a tie rod at its ends axially interconnecting said tubular bodies;

a cylindrical magnet within each tubular body of opposing polarity adjacent its opposite ends for delivering fluxes of corresponding polarity to adjacent portions of the corresponding enclosing pilot tube;

and a pusher rod at one end axially connected to one of said tubular bodies extending through said clearance and wiper plates and one side plate, and at its other end projecting from said pilot tube and connected to said pusher plate.

15. In the magnetic separator of claim 14, one of said tubular bodies being normally nested within its pilot tube and positioned within said plastic feed chamber, the other of said tubular bodies being axially outward of said plastic feed chamber;

whereby on retraction of said magnetic assembly, said one tubular body slides outwardly of said plastic feed chamber through and outwardly of said metal feed chamber, the other of said tubular bodies retracting into said plastic feed chamber.

16. In the magnetic separator of claim 1, laterally spaced parallel conveyors underlying said base plate and extending along the length of and below said plastic and metal feed chamber outlets for respectively receiving and transporting said separated plastic and metal materials.

17. In the magnetic separator of claim 1, and a plurality of spaced stops upon one side plate in registry with and adapted to limit inward movement of said pusher plate relative to said housing.

18. In the magnetic separator of claim 1, a second upright tube clearance plate within said housing intermediate said side plates and spaced from said first clearance plate having a corresponding series of oversized clearance apertures;

said clearance plates defining said plastic feed chamber;

a second upright wiper plate within said housing intermediate said second clearance plate and the other side plate having a corresponding series of apertures snugly receiving said tubes respectively;

said second clearance plate defining with said second wiper plate a second upright metal feed chamber for metal particles separated from said plastic material and having a throated outlet extending from said base plate.

19. In the magnetic separator of claim 18, reciprocal power means connected to said pusher plate, said magnetic assembly within each tube upon translation through said second clearance plate and second wiper plate, outwardly of said plastic feed chamber, sliding the accumulated metal material along the respective pilot tube through said second clearance plate and into and through said second metal feed chamber;

said second wiper plate stripping the metal materials from said tubes, said metal materials falling by gravity within said second metal feed chamber and through its outlet, said power means and pusher plate reciprocating each magnetic assembly.

20. In the magnetic separator of claim 19, each magnet assembly including a pair of aligned longitudinally spaced tubular bodies;

a tie rod at its ends axially interconnecting said tubular bodies;

a cylindrical magnet within each tubular body of opposing polarity adjacent its opposite ends for delivering fluxes of corresponding polarity to adjacent portions of the corresponding enclosing pilot tube;

and a pusher rod at one end axially connected to one of said tubular bodies and at its other end projecting from said pilot tube and connected to said pusher plate.

21. In the magnetic separator of claim 20, said reciprocal power means including at least one cylinder assembly having a piston rod connected to said pusher plate, one of said tubular bodies being normally nested within its pilot tube and positioned within said plastic feed chamber, the other of said tubular bodies being outwardly of said plastic feed chamber;

whereby on retraction of said magnetic assembly, said one tubular body slides outwardly of said plastic feed chamber through and outwardly of said metal feed chamber, the other of said tubular bodies retracting into said plastic feed chamber.

22. In the magnetic separator of claim 18, laterally spaced parallel conveyors underlying said base plate and extending along the length of and below the plastic and metal feed chamber outlets for respectively receiving said transporting said separated plastic and metal materials.

23. The method of separating a mixture of powdered plastic and metal materials which comprises the steps of:

introducing said mixture into the top of a plastic feed chamber containing therein a plurality of vertically spaced staggered rows of laterally spaced pilot tubes each containing a magnetic assembly;

cascading the mixture by gravity through a circuitous path over said tubes;

magnetically adhering the metal particles of said mixture to surface portions of said tubes during the downward flow of plastic material;

simultaneously retracting the magnetic assemblies in all of the tubes and magnetically sliding the accumulated metal particles adhering to said tubes out from the plastic feed chamber into a metal feed chamber;

and mechanically stripping the metal materials from the pilot tubes on retraction of the magnetic assemblies through and outwardly of said metal feed chamber;

the separated metal particles falling by gravity through said metal feed chamber;

independently collecting the separated plastic and metal materials falling from said plastic and metal feed chambers;

and the further step of advancing the magnetic assemblies simultaneously to their initial position within said plastic feed chamber.

* * * * *